United States Patent [19]

Regan

[11] Patent Number: 4,474,099

[45] Date of Patent: Oct. 2, 1984

[54] PIANO ADAPTOR

[75] Inventor: Lance Regan, Kamloops, Canada

[73] Assignee: Darlin Enterprises Ltd., Kamloops, Canada

[21] Appl. No.: 403,965

[22] Filed: Aug. 2, 1982

[30] Foreign Application Priority Data

Apr. 15, 1982 [CA] Canada ..... 401016

[51] Int. Cl.[3] ..... G10C 3/18

[52] U.S. Cl. ..... 84/253

[58] Field of Search ..... 84/216, 222, 223, 236, 84/253, 254, 255, 250

[56] References Cited

U.S. PATENT DOCUMENTS 3,640,171 2/1972 Giglio ..... 84/216

FOREIGN PATENT DOCUMENTS 986340 3/1976 Canada ..... 84/253

*Primary Examiner*—Donald A. Griffin

*Attorney, Agent, or Firm*—Sughrue, Mion, Zinn, Macpeak and Seas

[57] ABSTRACT

There is described a musical instrument such as a piano comprising a plurality of vibratile members such as wires capable of vibration to produce notes of selected frequencies, a hammer mechanism for each said vibratile member for causing vibration thereof, and an actuating mechanism for selectively rotating each hammer from a rest position to strike the vibratile member associated therewith and a return mechanism for rotating the hammer back to its rest position. A hammer rail is provided to support the hammer in a rest position. A control mechanism for the hammer includes a pivotally mounted adaptor having an inertial mass movable in a substantially vertically upwards direction and active upon the hammer when struck thereby to absorb the kinetic energy of the hammer moving towards the hammer rail to thereby exert a decelerative force upon the hammer. The hammer rail has a surface of resiliently deformable material such as felt which the hammer abuts in the rest position thereof. The pivotally mounted adaptor is located for striking by the hammer moving towards the hammer rail substantially at the moment of initial contact of the hammer with the felt.

35 Claims, 7 Drawing Figures

PIANO ADAPTOR

This invention relates to pianos and similar instruments, wherein notes of various frequencies are produced by striking vibratile members, such as strings or wires, and more particularly relates to a method of controlling the movement of the percussive means employed for such striking.

Various musical instruments are played by causing a percussive means (such as a hammer) to strike a vibratile member such as a taut string, wire or reed and thus produce a note of a pitch determined by the dimensions, tension, etc. of the vibratile member. Examples of such instruments are the piano, harpsichord, clavichord, dulcimer, etc. Of the instruments of this general class, the most common is probably the piano, which uses a plurality of hammer mechanisms to strike taut wires. Hereinafter, reference will be made to pianos only but it will be understood that the class of instruments of which some examples have been named above is to be included within the meaning of piano.

The hammer mechanism referred to includes a hammerhead carried on a stem which is pivotally mounted so that the hammer head may be caused to strike the wire by rotation of the stem about its pivot mounting. The stem normally rests against a hammer rail with the hammerhead remote from the wire, and remains in this position until the key associated therewith is depressed. Upon depression of the key, a mechanism associated therewith bears upon the stem and causes rapid rotation thereof so that the hammerhead is moved to strike the wire and produce the desired note. The hammerhead rebounds from the string and falls back under the weight of the action associated therewith until the stem strikes the hammer rail, the hammerhead thus promptly clearing the wire and allowing the clean vibration thereof and production of the desired note.

Particularly for the playing of repetitive notes upon the same key, it is extremely important that the stem be repositioned as quickly as possible after each strike of the hammer so that the mechanism is able to immediately reactivate the stem if required to do so. Unfortunately, the conventional key mechanism requires not only rapid but also accurate repositioning of the stem for repetition of the note. These require. ments are not wholly satisfied in all types of piano mechanisms including those relating to upright and grand pianos. The speed with which the hammer stem is returned to its original position causes the stem to impact the hammer rail with considerable force and rebound therefrom. As stated above, the conventional piano key mechanism requires that the hammer stem be accurately positioned before the mechanism is capable of activating same, and the aforementioned rebound condition seriously delays the stem from assuming such position. Thus, if the key is struck repetitively and in rapid succession, the hammer stem rebounds and does not have sufficient time to return fully and notes are therefore "missed". If the note is not missed altogether, the shortened stroke of the hammer due to the rebound condition can result in "weak" notes.

An object of the present invention is therefore to provide improved means for controlling and decelerating the return of the hammer stem against the hammer rail and thus greatly diminish or eliminate the rebound condition, which means may be readily applied to the percussive member of any instrument of the general type described hereinafter as a piano.

One such rebound control mechanism has been described in Canadian Pat. No. 986,340 dated Mar. 30, 1976 and issued to the inventor herein. The patented mechanism has been found to perform satisfactorily but is somewhat complicated in construction. The generation of small but audible amounts of noise have also been found to be associated with the use thereof and as well, the patented mechanism may permit a small but potentially significant amount of secondary rebound of the hammer mechanism away from the hammer rail.

According to the present invention, then, there is provided a musical instrument comprising a plurality of vibratile members capable of vibration to produce notes of selected frequencies, percussive means for each said vibratile member for causing vibration thereof, actuating means for selectively rotating each said percussive means from a rest position to strike a vibratile member associated therewith, return means for return rotation of said percussive means to said rest position, a stop member for said percussive means in said rest position, and a control mechanism for said percussive means including a pivotally mounted member having inertial means associated therewith movable in a substantially vertically upwards direction and active upon said percussive means when struck thereby to absorb the kinetic energy of said percussive means moving towards said stop member and thereby exert a decelerative force upon said percussive means, said stop member having a surface of resiliently deformable material which said percussive means abuts in said rest position thereof, and said pivotally mounted member being located for striking by said percussive means moving towards said stop member substantially at the moment of initial contact of said percussive means with said resiliently deformable material.

Embodiments of the invention will now be described in greater detail and will be better understood when read in conjunction with the following drawings in which.

As mentioned above, the present adaptor is intended to improve upon the inventor's prior adaptor as described and claimed in Canadian Pat. No. 986,340 in terms of simplified construction, reduced noise generation characteristics and operative efficiency. In respect of the latter, it is known from general principles of mechanics that a rising mass absorbs energy more efficiently than a falling mass and the present control mechanism has been modified in recognition of this principle. The present control mechanism is also structured, in one embodiment thereof, to return a portion of the kinetic energy of the hammer mechanism to the hammerhead itself in a countervailing direction for the purpose of cancelling residual amounts of kinetic energy in the hammerhead which could cause a secondary bounce of the hammerhead upon contact with a resiliently deformable layer of felt or similar material applied to the present adaptor to prevent noise.

Figure 1:
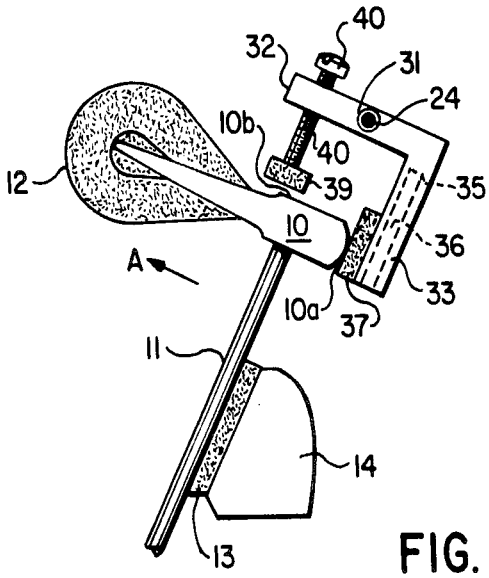
FIG. 1 is a side elevational view of one embodiment of the present control mechanism as described hereinafter.

Referring now to FIG. 1, a hammerhead 10 is supported by a stem 11 and provided with a hammer felt 12. The hammerhead is supported at its lower end by an actuating assembly (not shown) for causing the hammer to move quickly in the direction of arrow A upon depression of the key associated therewith and to strike the appropriate wire. The weight of the action in conjunction with a resilient return mechanism (not shown) associated with the stem causes the hammer to rebound and return quickly after striking the wire and move into abutment with the felt pad 13 located upon the hammer rail 14. These elements are quite conventional upon pianos of various types and need not be described further herein. As stated above, the hammerhead must return quickly after striking of the wire in order that it does not interfere with the clean vibration of the wire, and so that the hammer is repositioned for the next strike. However, the necessity for quick return gives rise to the problem of rebound. The hammer stem, returning quickly, strikes the felt pad 13 with considerable force, causing a tendency for the stem to rebound therefrom. Such rebound delays the proper repositioning of the lower end of the stem for subsequent action by the key mechanism thereupon, thus detrimentally affecting the facility of the piano for playing rapid, uniformly strong, repetitive notes.

Figure 2:
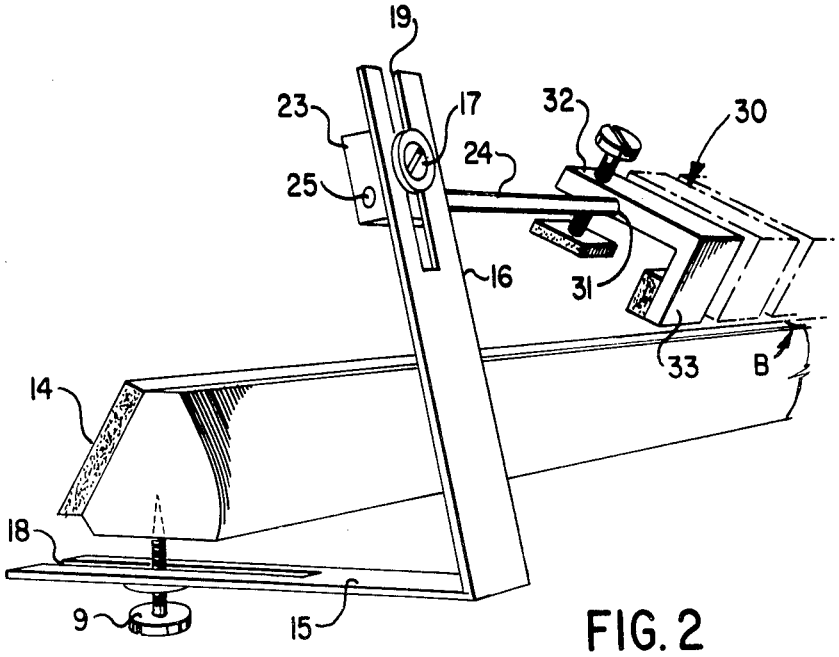
FIG. 2 is a perspective view of the control mechanism of FIG. 1 in situ.

In the rebound control mechanism shown in FIG. 2, the hammer rail 14 is provided at intervals therealong with slotted base clamps 15. Each base clamp is provided at its rear edge, remote from hammer rail 14, with an upstanding flange portion 16 which may be inclined towards hammer rail 14 at an acute angle to base clamp 15.

Each of base clamps 15 is slotted as at 18 and the hammer rail 14 is fastened to each of the base clamps by means of a screw and washer 9 passing through slot 18 and threadedly engaged with the hammer rail. The position of base clamps 15 may be transversely adjusted by loosening screw 9 and sliding same in slot 18 to the desired position and then tightening screw 9 to securely locate the base clamps. The purpose of this adjustment will be described below.

Each flange portion 16 is slotted as at 19 and an assembly rod clamp 23 is fastened to each of the flange portions 16 by means of a screw and washer 17 passing through slot 19 and threadedly engaged with assembly rod clamp 23. It will thusly be apparent that the relative height of each assembly rod clamp with respect to base clamp 15 may be adjusted by loosening screw 17 and sliding same in slot 19 to the desired position and tightening the screw to securely locate the assembly rod clamp. Again, the purpose of this adjustment will be more fully described below.

Assembly rod clamps 23 support an assembly rod 24 which extends the length of the present control mechanism which corresponds substantially to the length of hammer rail 14. Pivotally mounted members 30, sometimes hereinafter referred to simply as adaptors, are suspended at appropriately spaced intervals along assembly rod 24 so as to be associated with a corresponding hammer assembly. Each adaptor 30 has formed therein an aperture 31 dimensioned to loosely receive assembly rod 24 so as to be freely pivotable about the assembly rod for reasons to be more fully described below. Assembly rod clamps 23 may themselves be apertured as shown at 25 to snugly but slidably receive assembly rod 24 so that the assembly rod may be inserted therein or removed therefrom as required.

Each adaptor 30 includes an upper and lower arm, 32 and 33, respectively with aperture 31 being formed in upper arms 32.

Referring once again to FIG. 1, the lower end of arm 33 is hollowed out as at 35 to snugly receive therein a weight or mass such as a metal plug 36. The inner face of arm 33 facing the rear portion 10*a* of hammer head 10 is provided with a felt pad 37. It will be appreciated of course that a number of alternative methods of affixing mass 36 to lower arm 33 will be readily apparent to those skilled in the art, the method shown being exemplary only.

A second felt pad 39 disposed adjacent the upper face 10*b* of hammer head 10 is connected to upper arm 32 by means of a pin 40 which may be a fine adjustment screw passing through and threadedly engaged with upper arm 32. As indicated previously, aperture 31 is formed through upper arm 32 at a point along the length thereof to receive assembly rod 24 for suspending adaptor 30 at an angle as shown in FIG. 1 such that the face of felt pad 37 facing rear portion 10*a* of hammerhead 10 is arranged to be perpendicular to the longitudinal axis of the hammerhead. Felt pad 37 is positioned to abut the rear surface of portion 10*a* when the hammer stem 11 is at rest against pad 13 whereas felt pad 39 is positioned by its associated screw member 40 to be spaced from the upper surface 10*b* of hammerhead 10 when said hammerhead is at rest.

The mechanism operates as follows. When the key associated with a particular hammer is depressed, the hammerhead moves quickly in the direction of arrow A in FIG. 1. When the hammer returns, the stem 11 firstly contacts the surface of the felt pad 13. As the further motion of the stem 11 contacts and then starts to compress the felt pad 13, the rear portion 10*a* of the hammerhead strikes felt pad 37. The relative position of felt 37 to portion 10*a* in the horizontal plane is set by means of adjustment to the position of base clamp 15. Adjustments to the position of pad 37 in the vertical plane are made by adjusting the height of assembly rod clamp 23 along slot 16 as described above. As the rear portion 10*a* strikes felt pad 37, whose function in this regard is primarily to suppress and absorb the noise of contact, the energy of the hammer is transferred to adaptor 30 which pivots upwardly about assembly rod 24. The energy so transferred from the hammerhead to the adaptor is dissipated by the motion of mass 36 indicated by arrow B in FIG. 2, the principle component of which is in the vertical plane in view of the eccentric suspension of mass 36 about assembly rod 24.

Although all or substantially all of the kinetic energy of hammerhead is absorbed by adaptor 30 which effectively dissipates this energy by pivoting upwardly, some reactive forces, due primarily to the resiliency of felt pad 37 and the inertia of mass 36, are imparted to the hammerhead to cause a small secondary bounce thereof in a direction away from the hammer rail. To restrain this slight rebound, some of the energy of the hammerhead may be returned to the hammerhead in a countervailing direction by positioning felt pad 39 to contact upper surface 10*b* before the transferred energy is completely dissipated by the upward motion of mass 36. The force exerted by pad 39 is generally in the direction of the hammer rail to prevent the secondary bounce referred to above and also to prevent excessive movement of the hammerhead in a direction towards hammer rail 14.

It will be appreciated that frictional losses, the absorptive characteristics of felt pad 37 and the inertia of the hammer assembly when resting against pad 13 prevent any appreciable displacement or rebound of hammerhead 10 away from its resting position upon the return of adaptor 30 to its own resting position.

It will be noted that as compared with the rebound control mechanism described in Canadian Pat. No. 986,340, the number and precision of the various adjustments provided to prepare the mechanism for proper functioning have been substantially reduced. As mentioned previously, the adaptor is positioned vis a vis hammerhead 10 by relatively coarse adjustments to the position of base clamps 15 and assembly rod clamps 23. Assembly rod clamps 23 may themselves be adjusted to suspend assembly rod 24 at an incline corresponding to the shortening stroke of stems 11 towards the higher frequency notes of the piano. A fine adjustment to the position of pad 39 relative to upper face 10*b* is provided by screw 40.

The mass of plug 36 may be chosen empirically although it is calculable by those skilled in the art with reference to the mass of the hammerhead, the relative dimensions and mass of arms 32 and 33 and the counterweighting effect of pin 40 and felt pad 39 attached thereto. Similarly, the positioning of aperture 31 in upper arm 32 to suspend adaptor 30 at the proper angle relative to the longitudinal axis of hammerhead 10 may also be determined empirically but is also calculable by those skilled in the art having regard to the relative masses of plug 36 and pin 40 and also the respective lengths and unit masses of upper and lower arms 32 and 33.

Thus, by a combination of the described adjustment means and parameters, the assembly rod 24 with adaptors 30 suspended therefrom may be positioned to effectively check and control the return of the hammerhead and stem after striking of the note, and thereby optimize the proper positioning of the stem for reactivation by the piano key mechanism.

It has been found that the use of a weight 36 of uniform mass for each of the 88 adaptors required provides good results although where instruments of fine or exceptional precision are desired, the mass of each weight may be adjusted in relation to the mass of each of the associated hammer mechanisms. In one embodiment constructed by the applicant, a weight having a mass of less than 10 grams has been successfully utilized. If different masses are employed, slight adjustments to the locations of apertures 31 are also required to ensure the proper angle of suspension of adaptors 30 from suspension rod 24, such adjustments again being determinable either by experimentation or by calculation by those skilled in the art. Adaptors 30 may be spaced from one another by means of felt washers or other suitable means.

Figure 3:
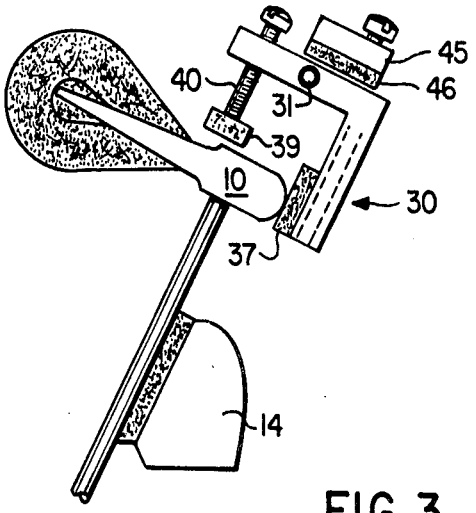
FIG. 3 is a side elevational view of another embodiment of the control mechanism of FIG. 1.

Turning now to FIG. 3, there is shown a further embodiment of the present invention further comprising a swing rail 45 having a felt pad 46 affixed to the bottom surface thereof. Swing rail 46 is positioned by any suitable means above adaptors 30 to extend along the entire length of the mechanism and is adjustable to limit the upward motion of adaptors 30 subsequent to being struck by their associated hammerheads when moving in a direction towards hammer rail 14.

Figure 4:
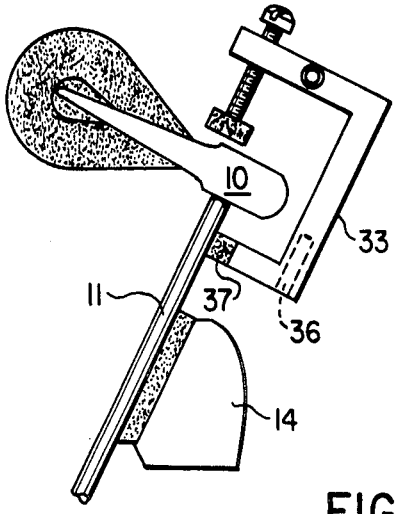
FIG. 4 is a side elevational view of a modification to the control mechanism of FIG. 1.

With respect to each of the embodiments described above, plug 36 has been described as being juxtaposed opposite hammer 10 and particularly end portion 10*a* thereof. As illustrated in FIG. 4, however, lower arm 33 may extend downwardly and inwardly to contact stem 11 at a point intermediate hammer rail 14 and head 10 if so desired although it will be appreciated that some losses of absorber efficiency will be experienced the further one moves from the hammerhead itself. It will be further appreciated by those skilled in the art that without departing from the inventive principles taught herein, the present adaptor may be arranged to contact the hammer felt 12 to effect energy transfer from that point.

Figure 5:
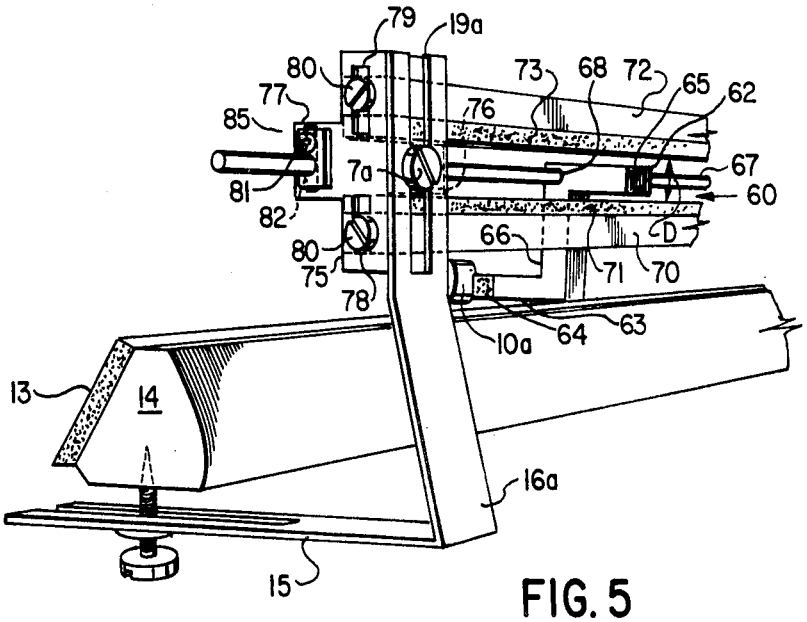
FIG. 5 is a perspective view of a further embodiment of the control mechanism described hereinafter.

Referring now to FIG. 5, there is illustrated a further embodiment of the present invention wherein an adaptor 60 includes a lower arm 63 having a felt pad 64 provided thereon opposite end portion 10*a* of hammerhead 10 and an upper arm 62 including a weight or mass 65 disposed adjacent the outer end thereof. Each adaptor is pivotally suspended from an assembly rod 67 passing through an aperture 68 located at the intersection of arm 62 and an intermediate arm 66.

A lower rail 70 having a felt pad 71 affixed to the upper surface thereof is provided to extend along the length of the mechanism to support respective ones of upper arms 62 so that lower arms 63 are aligned with the longitudinal axes of respective hammerheads 10. Pads 64 abut portions 10*a* of the hammerheads when stem 11 is at rest against the hammer rail.

An upper rail 72 which similarly extends along the length of the mechanism and which has a felt pad 73 provided along a bottom surface thereof, is disposed above rail 70 so that each of upper arms 62 lie between the two rails.

In the rebound control mechanism of FIG. 5, the hammer rail 14 is again provided, at least at its opposite ends, with slotted base clamps 15 having upstanding slotted flange portion 16*a* provided at their rear edges remote from the hammer rail. A slotted holding clamp 75 including a flange 76 is fastened to each of flange portions 16*a* by means of a screw 17*a* passing through slot 19*a* and threadedly engaged with the flange 76. The holding clamps themselves are slotted as at 78 and 79 and lower and upper rails 70 and 72 are fastened to the holding clamps by means of screws 80 passing through slots 78 and 79 and threadedly engaged with the rail members. Clamp 75 further includes a projection 77 having an additional slot 82 formed therein. An assembly rod clamp 85 having an aperture formed therein to receive assembly rod 67 is fastened to projection 77 by means of a screw 81 passing through the slot 82 and threadedly engaged with the assembly rod clamp.

It will be apparent from the foregoing that this entire assembly may be adjusted in the horizontal direction by means of adjustments to the positioning of base clamps 15 relative to hammer rail 14. Similarly, vertical adjustments in gross to that portion of the assembly including adaptors 60, rails 70 and 72 and assembly rods 67 can be made by loosening screw 17*a* and sliding screw 17*a* in slot 19*a* to move holding clamp 75 to the desired position and then tightening screw 17*a* to securely locate holding clamp 75. Adjustments to the relative positions and attitudes of each of the aforementioned elements can be similarly made by loosening the respective screw members fastening said elements to the holding clamp and sliding the screws in their respective slots to the desired positions.

In operation, this mechanism functions in much the same manner as the embodiments illustrated and described with reference to FIGS. 1 and 2. As the return or rebound motion of stem 11 contacts and then begins to compress pad 13, rear portion 10*a* of the hammerhead strikes felt pad 64 and the kinetic energy of the hammer mechanism is transferred to adaptor 60 causing upper arm 62 to pivot upwardly in the direction of arrow D about assembly rod 67. The transfer of energy to adaptor 60 and the dissipation of such energy due to the resultant lifting of mass 65 substantially if not completely eliminates any rebound of stem 11 from pad 13. This operation is of course completed upon the repositioning of upper arms 62 against pad 71. The position of rail 72 is adjusted to prevent excessive upward movement of adaptors 60 about assembly rods 67. The use of felt pads 64, 71 and 73 is intended primarily to reduce and absorb noise.

As described above, the correct mass of weight 65 and the relative dimensions of adaptor 60 may be readily determined by empirical means or may be calculated by those skilled in the art having regard to the specific application at hand.

Figure 6:
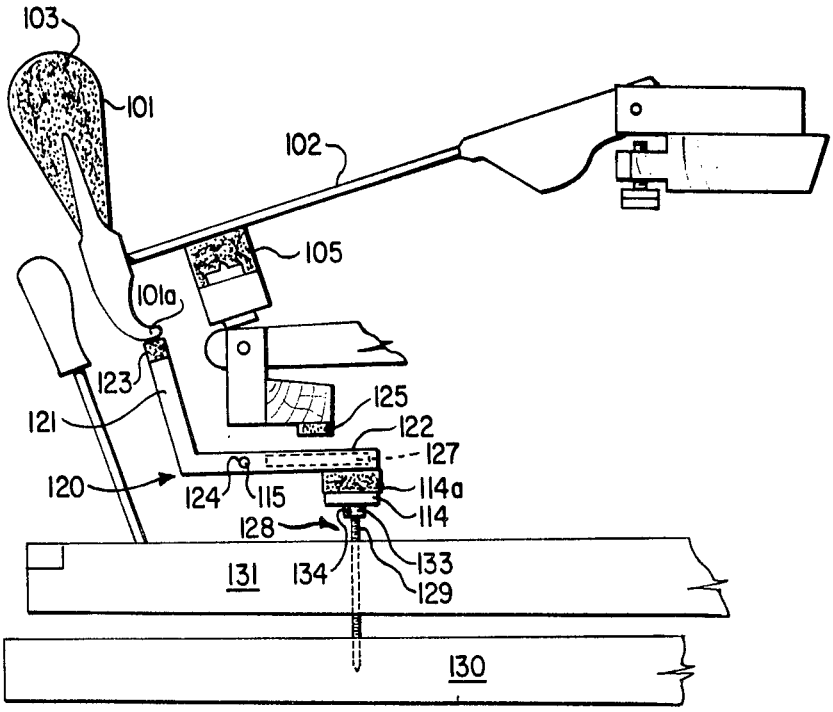
FIG. 6 is a side elevational view of a further embodiment of the present control mechanism adapted specifically for utilization with grand pianos.

Turning now to FIG. 6, there is shown a further embodiment of the present invention specifically adapted for use with grand pianos wherein the hammer is moved by its associated key mechanism in an upwardly extending arc to strike the piano wire and then rebounds from the wire to fall through a downwardly extending arc until the stem strikes the hammer rail.

FIG. 6 shows a hammer head 101 supported by a stem 102 and provided with a hammer felt 103. Stem 102, when in repose, rests against the hammer rail 105. The hammer assembly is supported and actuated by means not shown but which are well known in the art and therefore need not be described herein in further detail.

Figure 7:
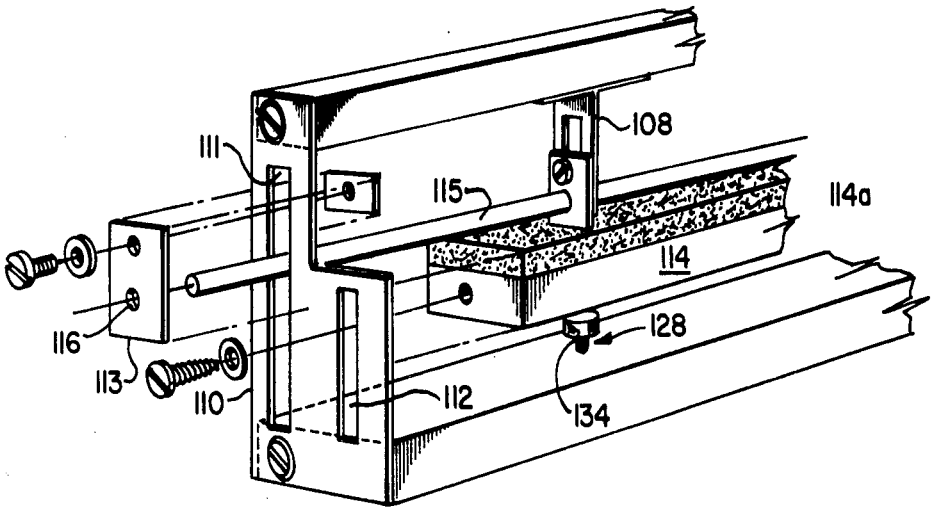
FIG. 7 is a perspective view of the control mechanism of FIG. 6 illustrating selected components thereof for greater clarity of presentation.

In the rebound control mechanism shown in FIGS. 6 & 7, a slotted holding clamp 110 is affixed by, for example, screws to a suitably adapted frame or rail member provided in the piano. Each holding clamp is provided with vertically extending slots 111 and 112. An assembly rod clamp 113 and a rail 114 are fastened to holding clamp 110 as shown by means of screws passing through slots 111 and 112 respectively and threadedly engaged with the assembly rod and rail. Assembly rod claim 113 is adapted to receive an assembly rod 115 through aperture 116 formed therein. Assembly rod 115 extends the length of the mechanism and may be supported at intervals therealong by means of additional adjustable assembly rod clamps suspended from an existing piano rail such as at 108.

Adaptors 120 are supported by assembly rod 115. Each adaptor 120, which comprises an upper arm 121 and a lower arm 122, is pivotally mounted about assembly rod 115 by means of an aperture 124 formed through respective lower arms 122. As shown, each lower arm 122 at the end thereof away from hammerhead 10 is provided with a weight or mass 127. The upper end of upper arm 121 adjacent portion 101*a* of hammerhead 101 is provided with a felt pad 123. Rail 114 includes a felt pad 114*a* which extends along the length thereof and may be supported, if required, at intervals by means of support pins 128. Support pins 128 include a lower threaded portion 129 passing between adjacent key assemblies 131 to threadedly engage the piano's action frame 130 and a head portion 133 having holes 134 formed therein to receive an adjustment tool for turning the support pins to raise or lower rail 114. This adjustment feature is particularly useful if the hammer assemblies are laid in a horizontally undulating pattern.

The height of rail 114 and assembly rod 115 is adjusted to suspend each of adaptors 120 to have upper arms 121 thereof arranged in parallel spaced relationship to the longitudinal axis of hammerhead 101 such that the outer face of felt pad 123 is tangential to and abuts the opposing face of portion 101*a* of the hammerhead when the hammerhead is at rest.

In operation, the mechanism functions substantially as described above wherein the energy of the hammerhead is absorbed by adaptor 120 which dissipates the energy by means of the upward rotation of mass 127 about assembly rod 115 to thereby prevent the rebound of hammer stem 102 away from hammer rail 105. An additional felt pad 125 affixed to the underside of an existing piano rail prevents excessive rotation of the adaptor about the assembly rod.

As before, the mass of weights 127 and the relative dimensions of upper and lower arms 121 and 122 may be determined empirically or by calculation for specific applications by those skilled in the art. Weights of uniform mass may be used in each adaptor or the masses may be specifically chosen having regard to the mass of the hammer mechanisms associated therewith.

Thus, it will be appreciated that there has been described a simplified mechanism of enhanced efficiency for controlling the rebound of a hammer or similar percussive member in an instrument of the general class described above, which mechanism is by no means restricted to the examples given above. In alternative arrangements, for example, adaptors 30, 60 and 120 may be formed to have other shapes including arcuate or other curvilinear forms or even angled configurations.

Furthermore, it is stressed that the precise nature of the instrument or the vibratile member employed therein is in no way limiting upon the scope of the present invention, which is applicable to any instrument which employs mechanically actuated percussive means and wherein the rate of return of said percussive means to the rest position requires to be controlled.

The embodiments of the invention in which an exclusive property or privilege is claimed are defined as follows:

1. A musical instrument comprising a plurality of vibratile members capable of vibration to produce notes of selected frequencies, percussive means for each said vibratile member for causing vibration thereof, actuating means for selectively rotating each said percussive means from a rest position to strike a vibratile member associated therewith, return means for rotating said percussive means back to said rest position, a stop member for said percussive means in said rest position, and a control mechanism for said percussive means including a pivotally mounted member having inertial means movable in a substantially vertically upwards direction and active upon said percussive means when struck thereby to absorb the kinetic energy of said percussive means moving towards said stop member and thereby exert a decelerative force upon said percussive means, said stop member having a surface of resiliently deformable material which said percussive means abuts in said rest position thereof, and said pivotally mounted member being located for striking by said percussive means moving towards said stop member substantially at the moment of initial contact of said percussive means with said resiliently deformable material.

2. The musical instrument of claim 1 wherein said pivotally mounted member is suspended having one end thereof located for striking by said percussive means and another end thereof remote from said percussive means.

3. The musical instrument of claim 2 wherein said pivotally mounted member is suspended about a transverse axis thereof for rotation in a direction substantially opposite to the direction of rotation of said percussive means as the latter moves towards said stop member, said transverse axis extending in a direction normal to the plane containing said rotation of said percussive means.

4. The musical instrument of claim 3 wherein said inertial means are provided at said one end of said pivotally mounted member located for striking by said percussive means, said pivotally mounted member being suspended for eccentric rotation about said transverse axis thereof such that said inertial means are movable principally in the vertical plane to dissipate the energy of said percussive means.

5. The musical instrument of claim 4 wherein said other end of said pivotally mounted member remote from said percussive means is disposed above an upper surface of said percussive means, and has depending therefrom in a direction towards said upper surface pin means adapted at one end thereof to contact said upper surface when said pivotally mounted member is struck by said percussive means to thereby exert a further decelerative force upon said percussive means.

6. The musical instrument of claim 5 wherein said one end of said pivotally mounted member includes a surface of resiliently deformable material thereon which said percussive means abut in said rest position thereof.

7. The musical instrument of claim 6 wherein said one end of said pin means has provided thereon a surface of resiliently deformable material which contacts said upper surface of said percussive means during the deceleration thereof and is spaced from said upper surface in said rest position of said percussive means.

8. The musical instrument of claim 7 wherein said percussive means comprise a hammerhead for striking a vibratile member and a stem upon which said hammerhead is carried, said stem being rotatable about a transverse axis thereof separated from said hammerhead.

9. The musical instrument of claim 8 wherein said pivotally mounted member is directly active upon said hammerhead.

10. The musical instrument of claim 9 wherein said resiliently deformable surface provided at said one end of said pivotally mounted member is arranged to be perpendicular to the longitudinal axis of said hammerhead.

11. The musical instrument of claim 8 wherein said control mechanism includes adjustment means to facilitate horizontal and vertical adjustments to the position of said pivotally mounted member to properly locate said pivotally mounted member for striking by said percussive means.

12. The musical instrument of claim 11 wherein said pin means are adjustable to vary said space between said surface of resiliently deformable material provided at said one end thereof and said upper surface of said percussive means.

13. The musical instrument of claim 12 wherein said control mechanism further includes a stop member adapted to limit the upward rotation of said pivotally mounted member about the transverse axis thereof.

14. The musical instrument of claim 5 wherein said inertial means comprise an energy absorbing mass.

15. The musical instrument of claim 3 wherein said inertial means are provided at said other end of said pivotally mounted member remote from said percussive means, said pivotally mounted member being supported for rotation about said transverse axis thereof such that said inertial means are movable principally in the vertical plane to dissipate the energy of said percussive means.

16. The musical instrument of claim 15 wherein said other end of said pivotally mounted member remote from said percussive means extends in a direction away from said percussive means and is supported in a rest position thereof by first transversely extending stop means.

17. The musical instrument of claim 16 wherein said one end of said pivotally mounted member includes a surface of resiliently deformable material thereon which said percussive means abut in said rest position thereof.

18. The musical instrument of claim 17 wherein said percussive means comprise a hammerhead for striking a vibratile member and a stem upon which said hammerhead is carried, said stem being rotatable about a transverse axis thereof separated from said hammerhead.

19. The musical instrument of claim 18 wherein said pivotally mounted member is directly active upon said hammerhead.

20. The musical instrument of claim 19 wherein said resiliently deformable surface provided at said one end of said pivotally mounted member when in the rest position thereof is arranged to be perpendicular to the longitudinal axis of said hammerhead.

21. The musical instrument of claim 19 wherein said control mechanism includes adjustment means to facilitate horizontal and vertical adjustments to the position of said pivotally mounted member to properly locate said pivotally mounted member for striking by said percussive means.

22. The musical instrument of claim 21 wherein said control mechanism further includes second transversely extending stop means adapted to limit the upward rotation of said pivotally mounted member about the transverse axis thereof.

23. The musical instrument of claim 22 wherein said second stop means is arranged in vertically spaced, longitudinally aligned parallel relation to said first stop means.

24. The musical instrument of claim 23 wherein opposed faces of said first and second stop means include a surface layer of resiliently deformable material.

25. The musical instrument of claim 24 wherein said inertial means comprise an energy absorbing mass.

26. The musical instrument of claim 2 wherein said pivotally mounted member is provided about a transverse axis thereof for rotation in the direction of rotation of said percussive means as the latter moves towards said stop member, said transverse axis extending in a direction normal to the plane containing said rotation of said percussive means.

27. The musical instrument of claim 26 wherein said inertial means are provided at said other end of said pivotally mounted member remote from said percussive means, said pivotally mounted member being supported for rotation about said transverse axis thereof such that said inertial means are movable principally in the vertical plane to dissipate the energy of said percussive means.

28. The musical instrument of claim 27 wherein said other end of said pivotally mounted member remote from said percussive means extneds in a direction towards said actuating means for selectively moving said percussive means from a rest.

29. The musical instrument of claim 28 wherein said one end of said pivotally mounted member includes a surface of resiliently deformable material thereon which said percussive means abut in said rest position thereof.

30. The musical instrument of claim 29 wherein said percussive means comprise a hammerhead for striking a vibratile member and a stem upon which said hammerhead is carried, said stem being rotatable in a generally upwards direction about a transverse axis thereof spaced from said hammerhead, said vibratile member being disposed above said percussive means.

31. The musical instrument of claim 30 wherein said pivotally mounted member is directly active upon said hammerhead.

32. The musical instrument of claim 31 wherein said resiliently deformable surface provided at said one end of said pivotally mounted member is arranged to be perpendicular to the longitudinal axis of said hammerhead.

33. The musical instrument of claim 31 wherein said control mechanism includes adjustment means to enable the proper positioning of said pivotally mounted member so that said pivotally mounted member is properly located for striking by said percussive means.

34. The musical instrument of claim 33 wherein said control mechanism includes second stop means to limit the upward rotation of said pivotally mounted member about the transverse axis thereof.

35. The musical instrument of claim 34 wherein said inertial means comprise an energy absorbing mass.

* * * * *